US006206760B1

(12) United States Patent
Chang et al.

(10) Patent No.: US 6,206,760 B1
(45) Date of Patent: Mar. 27, 2001

(54) METHOD AND APPARATUS FOR PREVENTING PARTICLE CONTAMINATION IN A POLISHING MACHINE

(75) Inventors: Yu-Chia Chang; Jain-Li Wu; Chung-I Cheng; Chih-Chiang Yang, all of Hsin-Chu; Pei Wei Yeh, Tainan; Yung-Tai Tseng, Hsin-Chu, all of (TW)

(73) Assignees: Taiwan Semiconductor Manufacturing Company, Ltd., Hsin Chu (TW); Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/342,940

(22) Filed: Jun. 29, 1999

Related U.S. Application Data

(60) Provisional application No. 60/117,813, filed on Jan. 28, 1999.

(51) Int. Cl.[7] ..... B24B 1/00

(52) U.S. Cl. ..... 451/41; 451/444; 451/449

(58) Field of Search ..... 451/444, 449, 451/41

(56) References Cited

U.S. PATENT DOCUMENTS 5,993,298 * 11/1999 Duescher ..... 451/56

6,036,582 * 3/2000 Aizawa et al. ..... 451/41

* cited by examiner

*Primary Examiner*—Stephen F. Gerrity
*Assistant Examiner*—Shantese McDonald
(74) *Attorney, Agent, or Firm*—Tung & Associates

(57) ABSTRACT

The present invention discloses a method for preventing particle contamination in a polishing machine that utilizes slurry composition for the removal of material from the surface of a substrate. The novel method is particularly suited for use in a chemical mechanical polishing apparatus in which a slurry composition is used. The method includes the step of providing a plurality of cleaning devices each having a bendable, shapable conduit and a spray nozzle for dispensing a cleaning solvent on the spindle and the conditioner arm utilized in the CMP apparatus. The present invention further discloses an apparatus for use in carrying out a method for preventing particle contamination in a CMP apparatus by using bendable, shapable conduits for dispensing a cleaning solvent such as deionized water onto the chamber components for removing slurry deposits that may have splattered thereon and therefore, eliminating sources for particle contamination.

25 Claims, 4 Drawing Sheets

METHOD AND APPARATUS FOR PREVENTING PARTICLE CONTAMINATION IN A POLISHING MACHINE

This application claims priority to provisional Application No. 60/117,813 filed Jan. 28, 1999.

FIELD OF THE INVENTION

The present invention generally relates to a method and apparatus for preventing particle contamination in a polishing machine that utilizes slurry for material removal and more particularly, relates to a method and apparatus for preventing particle contamination in a chemical mechanical polishing apparatus wherein a plurality of bendable, shapeable conduits and spray nozzles or air atomizing nozzles are utilized to spray a cleaning solvent such as deionized (DI) water for removing slurry particles accumulated in the polishing apparatus such that any contamination of a wafer being polished in the apparatus can be avoided.

BACKGROUND OF THE INVENTION

Apparatus for polishing thin, flat semi-conductor wafers is well known in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devises on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A perspective view of a typical CMP apparatus is shown in FIG. 1A. The CMP apparatus 10 consists of a controlled mini-environment 12 and a control panel section 14. In the controlled mini-environment 12, typically four spindles 16, 18, 20, and 22 are provided (the fourth spindle 22 is not shown in FIG. 1A) which are mounted on a cross-head 24. On the bottom of each spindle, for instance, under the spindle 16, a polishing head 26 is mounted and rotated by a motor (not shown). A substrate such as a wafer is mounted on the polishing head 26 with the surface to be polished mounted in a face-down position (not shown). During a polishing operation, the polishing head 26 is moved longitudinally along the spindle 16 in a linear motion across the surface of a polishing pad 28. As shown in FIG. 1A, the polishing pad 28 is mounted on a polishing disc 30 rotated by a motor (not shown) in a direction opposite to the rotational direction of the polishing head 26.

Also shown in FIG. 1A is a conditioner arm 32 which is equipped with a rotating conditioner disc 34. The conditioner arm 32 pivots on its base 36 for conditioning the polishing pad 38 for the in-situ conditioning of the pad during polishing. While three stations each equipped with a polishing pad 28, 38 and 40 are shown, the fourth station is a head clean load/unload (HCLU) station utilized for the loading and unloading of wafers into and out of the polishing head. After a wafer is mounted into a polishing head in the fourth head cleaning load/unload station, the cross head 24 rotates 90° clockwise to move the wafer just loaded into a polishing position, i.e., over the polishing pad 28. Simultaneously, a polished wafer mounted on spindle 20 is moved into the head clean load/unload station for unloading.

A cross-sectional view of a polishing station 42 is shown in FIGS. 1B and 1C. As shown in FIG. 1B, a rotating polishing head 26 which holds a wafer 44 is pressed onto an oppositely rotating polishing pad 28 mounted on a polishing disc 30 by adhesive means. The polishing pad 28 is pressed against the wafer surface 46 at a predetermined pressure. During polishing, a slurry 48 is dispensed in droplets onto the surface of the polishing pad 28 to effectuate the chemical mechanical removal of materials from the wafer surface 46.

An enlarged cross-sectional representation of the polishing action which results from a combination of chemical and mechanical effects is shown in FIG. 1C. The CMP method can be used to provide a planner surface on dielectric layers, on deep and shallow trenches that are filled with polysilicon or oxide, and on various metal films. A possible mechanism for the CMP process involves the formation of a chemically altered layer at the surface of the material being polished. The layer is mechanically removed from the underlying bulk material. An outer layer is than regrown on the surface while the process is repeated again. For instance, in metal polishing, a metal oxide layer can be formed and removed repeatedly.

During a CMP process, a large volume of a slurry composition is dispensed. The slurry composition and the pressure applied between the wafer surface and the polishing pad determine the rate of polishing or material removal from the wafer surface. The chemistry of the slurry composition plays an important role in the polishing rate of the CMP process. For instance, when polishing oxide films, the rate of removal is twice as fast in a slurry that has a pH of 11 than with a slurry that has a pH of 7. The hardness of the polishing particles contained in the slurry composition should be about the same as the hardness of the film to be removed to avoid damaging the film. A slurry composition typically consists of an abrasive component, i.e., hard particles and components that chemically react with the surface of the substrate. For instance, a typical oxide polishing slurry composition consists of a colloidal suspension of oxide particles with an average size of 30 nm suspended in an alkali solution at a pH larger than 10. A polishing rate of about 120 nm/min can be achieved by using this slurry composition. Other abrasive components such as ceria suspensions may also be used for glass polishing where large amounts of silicon oxide must be removed. Ceria suspensions act as both the mechanical and the chemical agent in the slurry for achieving high polishing rates, i.e., large than 500 nm/min. While ceria particles in the slurry composition remove silicon oxide at a higher rate than do silica, silica is still preferred because smoother surfaces can be produced. Other abrasive components, such as alumina ($Al_3O_2$) may also be used in the slurry composition.

A slurry composition is a material that easily accumulates after contacting dry air or without proper circulation of air. When slurry is left on the surface of the process environment, i.e., on the surface of the spindles or the conditioner arms in a CMP machine, it will dry and accumulate to become a source of particle contamination for the wafers that are processed in the polishing chamber. Slurry particles can easily fall from moving parts to the polishing pad due to mechanical vibration of the CMP apparatus to cause macro-scratch of the wafer surface. Slurry particles may also become source of particle contaminants for the wafer surface and for the chamber environment. It is therefore highly desirable that particle contaminants resulting from dry slurry to be avoided or eliminated.

It is therefore an object of the present invention to provide a method for preventing particle contamination in a CMP apparatus that does not have the drawbacks or shortcomings of the conventional CMP apparatus.

It is another object of the present invention to provide a method for preventing particle contamination in a CMP apparatus that utilizes slurry composition by preventing the formation of particles from the slurry composition.

It is a further object of the present invention to provide a method for preventing particle contamination in a CMP apparatus by providing a plurality of fluid conduits and spray nozzles or air atomizing nozzle in the polishing chamber for the cleaning of dried slurry that was splattered on the machine surface.

It is another further object of the present invention for preventing particle contamination in a CMP apparatus by providing a plurality of bendable, shapable conduits and spray nozzles or air atomizing nozzle for spraying a cleaning solvent onto a spindle surface for preventing slurry accumulation on the surface.

It is still another object of the present invention to provide a method for preventing particle contamination in a CMP apparatus by providing a plurality of shapable conduits equipped with spray nozzles or air atomizing nozzle for cleaning spindles and conditioner arms of slurry deposits before the formation of particles contaminants.

It is yet another object of the present invention to provide a polishing machine that is equipped with a cleaning apparatus for preventing particle contamination on a substrate that includes a plurality of cleaning devices position juxtaposed to each spindle and conditioner arm for spraying a cleaning solvent and removing slurry deposits on the components.

It is still another further object of the present invention to provide a CMP apparatus equipped with a cleaning means for preventing particle contamination on a wafer which includes a plurality of shapable conduits equipped with spray nozzles or air atomizing nozzle for spraying a cleaning solvent on the machine components such that slurry deposits on the components can be removed becoming contaminating particles.

It is yet another further object of the present invention to provide a method for preventing particle contamination in a CMP apparatus by providing a plurality of bendable, shapable conduits equipped with spray nozzles or air atomizing nozzle for spraying a cleaning solvent onto the chamber components for preventing slurry deposits on the chamber components from becoming contaminating particles.

SUMMARY OF THE INVENTION

In accordance with the present invention, a method and a apparatus for preventing particle contamination in a polishing machine such as a chemical mechanical polishing apparatus are provided.

In a preferred embodiment, a method for preventing particle contamination in a polishing machine that utilizes slurry composition can be carried out by the operating steps of first providing at least one polishing head that is mounted in at least one spindle for holding at least one substrate that has a surface to be polished in a face-down position, providing at least polishing disc for holding a polishing pad that has a frictional surface in a face-up position, pressing the surface of the substrate against the frictional surface of the polishing pad when the at least one polishing head and the at least one polishing disc are rotated in opposite directions, dispensing particle-containing slurry inbetween the substrate surface and the fictional surface, and dispensing a cleaning solvent on the at least one spindle for preventing accumulation of the particle-containing slurry on vertical and horizontal surfaces on the at least one spindle.

The method for preventing particle contamination in a polishing machine that utilizes slurry composition may further include the step of providing a chemical mechanical polishing apparatus that is equipped with at least one polishing head mounted in at least one spindle. The method may further include the step of providing three polishing heads mounted in three individual spindles, respectfully. The method may further include the step of providing the at least one substrate in a silicon wafer. The method may further include the step of providing a head clean load/unload station in the polishing machine adapted for head cleaning, wafer load and unload operations.

The method for preventing particle contamination in a polishing machine may further include the step of dispensing a cleaning solvent of de-ionized water on the at least one spindle. The method may further include the step of providing a plurality of solvent dispensing conduits each equipped with a spray nozzle or air atomizing nozzle for dispensing the cleaning solvent. The plurality of solvent dispensing conduits may be formed of bendable, shapable tubes capable of being bent and being held in its deformed shape. The plurality of solvent dispensing conduits may be formed of bendable, shapable tubes constructed of a metal helical tape. The plurality of solvent dispensing conduits may also be formed of bendable, shapeable tubes constructed of a plastic helical tape. The dispense rate of solvent may be adjusted by a flow regulator. The method may further include at least one solvent dispensing conduit that is situated at each of the corners of the polishing chamber.

The present invention is further directed to a polishing machine that is equipped with a cleaning apparatus for preventing particle contamination on a substrate that includes a machine base portion that has at least one spindle equipped with a least one polishing disc with a polishing pad mounted thereon. A spindle equipped with a polishing head and a corresponding head clean/load/unload disc mounted on the machine base portion, a plurality of cleaning devices each including a bendable, shapable conduit and a spray nozzle or air atomizing nozzle adapted for dispensing a cleaning solvent and is mounted on the machine base portion with the at least one cleaning device juxtaposed to each of the at least one spindle equipped with polishing head, and a cleaning solvent reservoir for supplying a pressurized flow of cleaning solvent through the plurality of cleaning devices for cleaning vertical and horizontal surfaces on the at least one spindle for preventing particle contamination.

In the polishing machine that is equipped with a cleaning apparatus for preventing particle contamination on a substrate, the machine base portion may be equipped with four spindles each having a polishing head, three polishing discs and a head clean/load/unload disc. The four spindles may be mounted in a unitary cross member that is equipped with four motors for rotating the four spindles, respectively. The bendable, shapable conduit may be formed of a helical metal tape construction. The polishing machine may further include a conditioner arm which is equipped with a conditioner disc for each of the polishing discs equipped with a polishing pad, the conditioner arm may be mounted on the machine base portion, and a cleaning device which includes a bendable, shapable conduit and spray nozzle (or air atomizing nozzle) may be mounted on the machine base portion adjacent to each of the conditioner arm. The polishing machine may further include a cleaning solvent reservoir for supplying a pressurized flow of DI water through the plurality of cleaning devices.

In an alternate embodiment, a method for preventing particle contamination in a chemical mechanical polishing apparatus may be carried out by the steps of providing at least one polishing head that is mounted in at least one spindle for holding a wafer, providing at least one conditioner arm that is equipped with a conditioner disc, mounting the at least one spindle and the at least one conditioner arm on a machine base portion of the polishing apparatus, mounting a cleaning device including a bendable, shapable conduit and a spray nozzle or air atomizing nozzle adjacent to each of the at least one spindle and the at least one conditioner arm, polishing a wafer that is held in the at least one polishing head against a corresponding polishing pad when both are rotated in opposite directions with a slurry composition dispensed thereinbetween, and dispensing a cleaning solvent from the spray nozzle on the at least one spindle and the at least one conditioner arm and removing any slurry deposited thereon to prevent particle contamination on the wafer.

The method for preventing particle contamination in a CMP apparatus may further include the step of providing four polishing heads mounted in four spindles for holding wafers. The cleaning solvent utilized may be deionized water or any other suitable cleaning solvent. The method may further include the step of providing a cleaning solvent reservoir for dispensing a pressurized cleaning solvent of DI water.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENTS

The present invention discloses a method for preventing particle contamination in a polishing machine that utilizes slurry composition, and particularly for polishing machines of the chemical and mechanical polishing type. The method includes the novel step of dispensing a cleaning solvent on at least one spindle in the polishing chamber for removing the accumulation of the particle-containing slurry deposits on vertical and horizontal surfaces of the at least one spindle. The method may further include the step of dispensing the same cleaning solvent on at least one conditioner arm for removing particle-containing slurry deposits on the arm. The cleaning solvent utilized may be suitably deionized water or any other suitable solvents.

The present invention further discloses a polishing machine that is equipped with a cleaning apparatus for preventing particle contamination on a substrate by utilizing a plurality of cleaning devices each including a bendable, shapable conduit and a spray nozzle or air atomizing nozzle adapted for dispensing a cleaning solvent such as deionized water. The plurality of cleaning devices are mounted on a machine base with at least one cleaning device mounted adjacent to each of the at least one spindle equipped with a polishing head. The cleaning apparatus my further include a cleaning solvent reservoir for supplying a pressurized flow of cleaning solvent such as DI water through the plurality of cleaning devices for removing slurry deposits from vertical and horizontal surfaces on the at least one spindle to prevent particle contamination. The polishing machine may further include a conditioner arm that is equipped with a conditioner disc for each of the polishing discs equipped with a polishing pad, the conditioner arm may be mounted on the machine base, and a cleaning device that includes a bendable, shapable conduit and a spray nozzle or air atomizing nozzle that are mounted on the machine base adjacent to each of the conditioner arms.

The present invention further discloses a method for preventing particle contamination in a CMP apparatus which includes the step of carrying out a CMP process and simultaneously dispensing a cleaning solvent from a spray nozzle and a bendable, shapable conduit or air atomizing nozzle on the at least one spindle and the at least one conditioner arm situated in the polishing chamber for removing slurry deposits on the spindle and on the arm to prevent particle contamination in the polishing chamber. A suitable cleaning solvent used is DI water or any other suitable solvents.

Figure 1A:
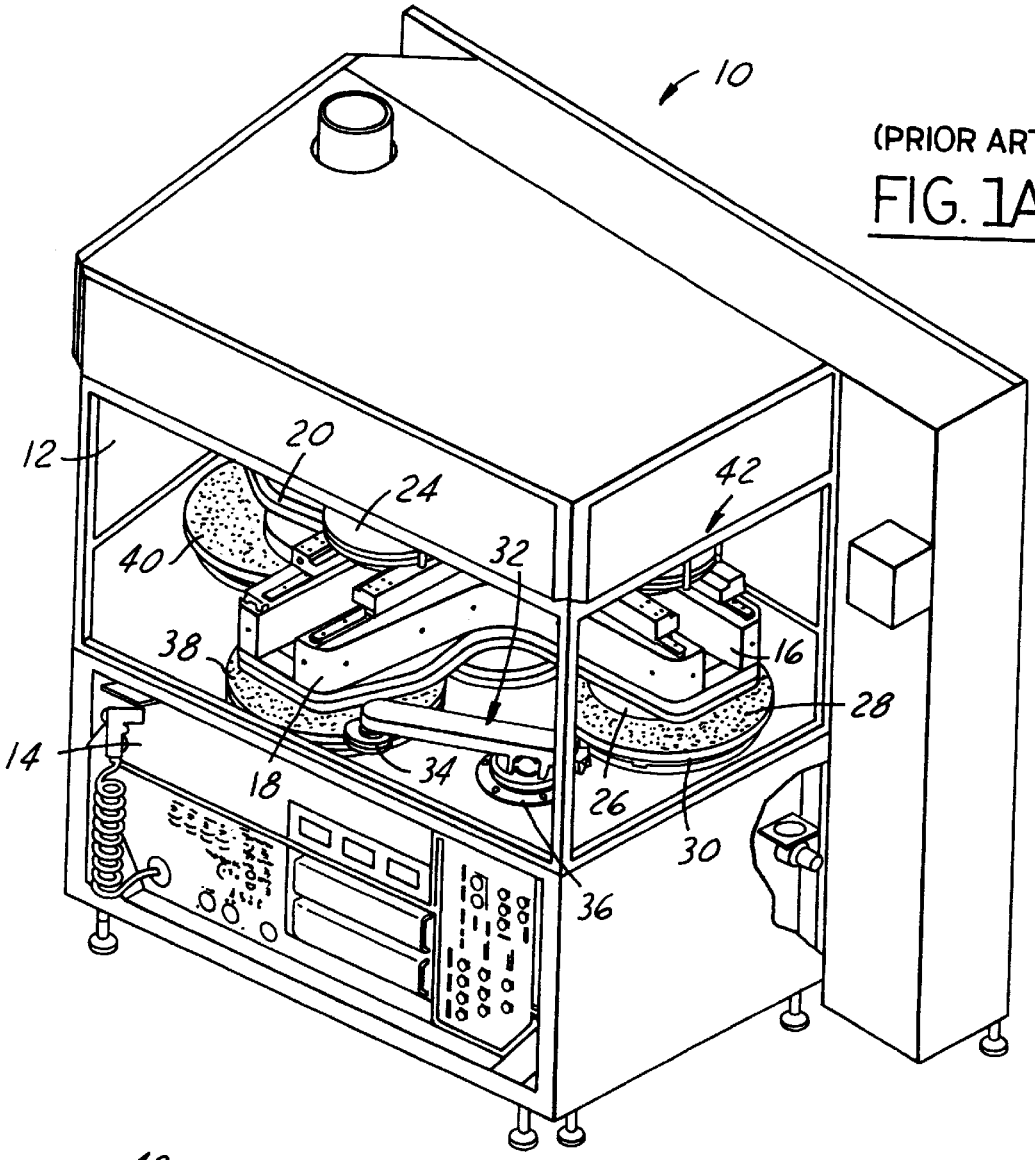
(PRIOR ART) FIG. 1A
FIG. 1A is a prospective view of a conventional chemical mechanical polishing apparatus illustrating three spindles and three polishing pads.
Figure 1B:
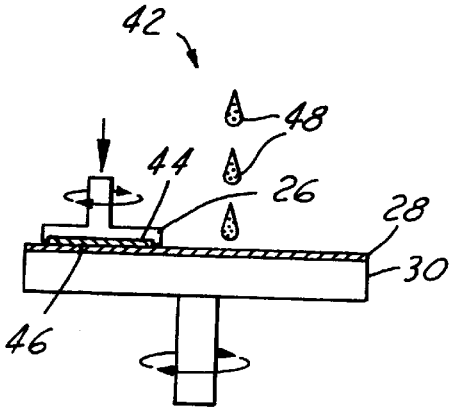
(PRIOR ART) FIG. 1B
FIG. 1B is a cross-sectional view of a polishing station wherein a wafer mounted in a polishing head is pressed against a polishing pad mounted on a polishing disc.
Figure 1C:
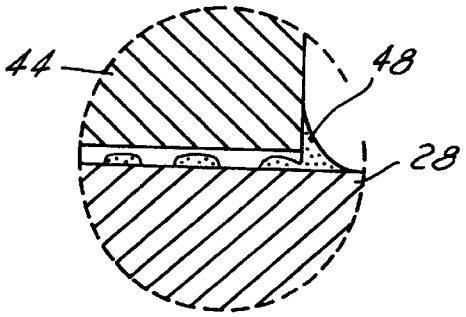
(PRIOR ART) FIG. 1C
FIG. 1C is an enlarged, cross-sectional view illustrating the interaction of a slurry composition with surfaces of a wafer and a polishing pad.
Figure 2A:
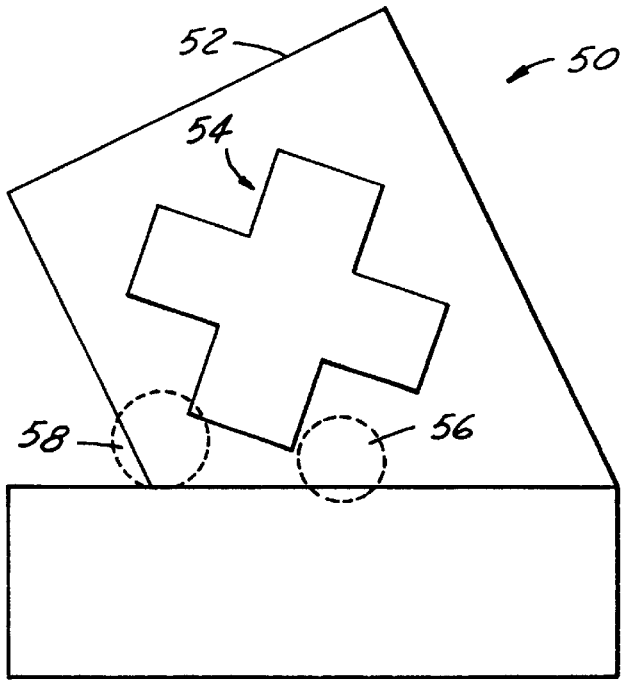
FIG. 2A is schematic of the present invention illustrating the position of the spindle clean module.

Referring now to FIG. 2A, wherein a simplified plane view of a present invention CMP apparatus 50 is shown. In the apparatus 50, a polishing chamber 52 houses a cross member 54 equipped with four spindles (not shown). Two spindle clean modules 56, 58 are positioned adjacent to the spindle positioned in the lower corner.

Figure 2B:
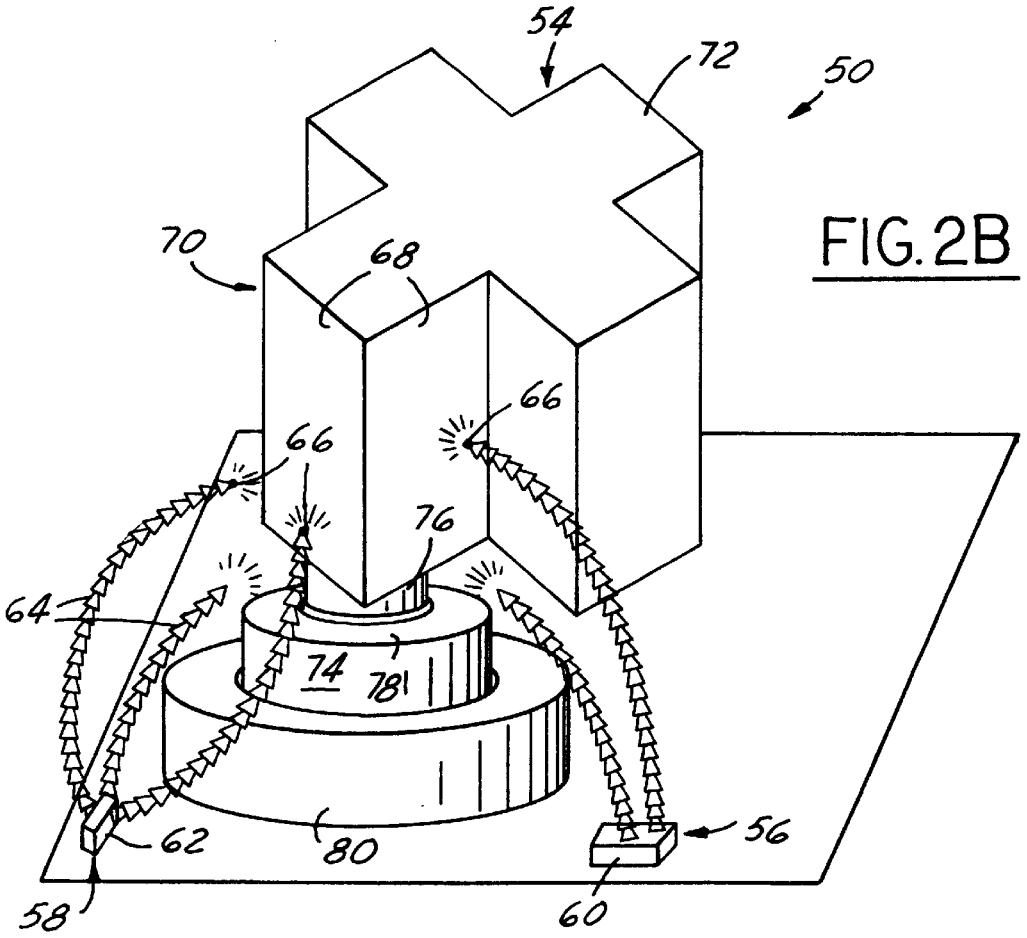
FIG. 2B is a perspective view of the present invention cleaning apparatus positioned in relation to a spindle and a polishing pad.

The spindle clean modules 56, 58 are shown in a perspective view of the present invention apparatus in FIG. 2B. It is seen that in each of the spindle clean modules 56, 58, a water manifold module 60, 62 is used for controlling the DI water pressure or the cleaning solvent pressure for feeding into bendable, shapable conduits 64. The bendable, shapable conduits 64 may be suitably fabricated of a helical wound metal tape such that it may be bent or twisted into any shape and retains the shape. The word shapable, as used in this specification defines a conduit that is not only twistable and bendable, but also capable of holding its shape after it is bent or twisted. Any other construction of conduits may also be used as long as the conduit retains its shape after being bent or twisted. At the tip of the bendable, shapable conduit 64, a spray nozzle 66 is mounted for spraying a cleaning solvent toward the vertical surface 68 of the spindle 70. While only the vertical surfaces 68 were sprayed upon, as shown in FIG. 2B, the bendable, shapable conduits 64 may also be bent toward the top horizontal surface 72 of the cross member 54 for cleaning any slurry deposits that may have splattered thereon.

As shown in FIG. 2B, the spindle 70 is connected with a polishing head 74 through a rotatable shaft 76. The arrangement shown in FIG. 2B indicates that the polishing head 74 is situated in a head clean/load/unload station 80 that is used for cleaning the polishing head, and loading/unloading a wafer (not shown) thereto, or therefrom. The conduits 64 may also be aimed at the rotatable shaft 76 and the top horizontal surface 78 of the polishing head 74 for removing any slurry deposits. The spindle clean modules 56, 58 may further be positioned at the other three spindles that are mounted on the cross member 54.

Figure 2C:
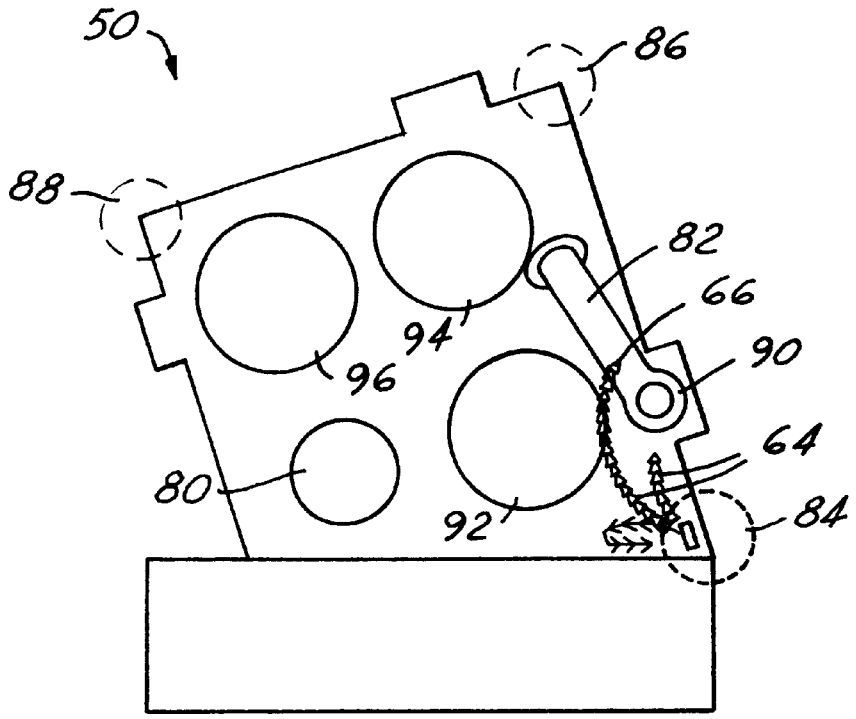
FIG. 2C is a plane view of the present invention cleaning apparatus positioned in relation to a conditioner arm.

A plane view of the present invention CMP apparatus 50 is shown in FIG. 2C illustrating a conditioner arm 82 and global irrigation systems 84, 86 and 88. While the construction of the irrigation systems 86, 88 are not shown, the global irrigation system 84 is representative of all the systems. It is shown that, in the global irrigation system 84, conduits 64 that are bendable and shapable are utilized in a way similar to that shown in FIG. 2B for the spindle clean modules, 56, 58. The bendable, flexible conduits 64 are further equipped with spray nozzles 66 which are aimed at the conditioner arm 82 or the conditioner disc 90 for removing any slurry deposits splattered thereon during the chemical mechanical polishing process. Polishing pads 92, 94 and 96 are also shown in FIG. 2C without the spindle in place. It should be noted that for each of the polishing pad positions, e.g., for each of 92, 94 and 96, a conditioner arm 82 is utilized for the in-situ conditioning of the respective polishing pads.

Figure 2D:
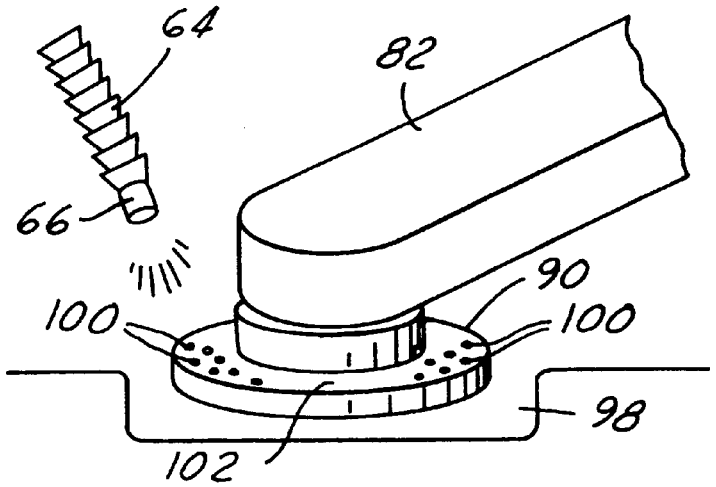
FIG. 2D is a perspective view of the present invention cleaning apparatus positioned in relation to a conditioner arm and a conditioner clean cup.

A detailed perspective view of the conditioner arm 82 and the conditioner disc 90 resting in a conditioner clean cup 98 is shown in FIG. 2D. It is seen that slurry deposits 100 have cumulated on the top horizontal surface 102 of the conditioner disc 90. Bendable, shapable conduit 64 and nozzle 66 are used to clean the slurry deposits 100 cumulated on the top surface 102 of the conditioner disc 90. This cleaning process can be carried out when the conditioner disc 90 is positioned in the clean cup 98.

Figure 3:
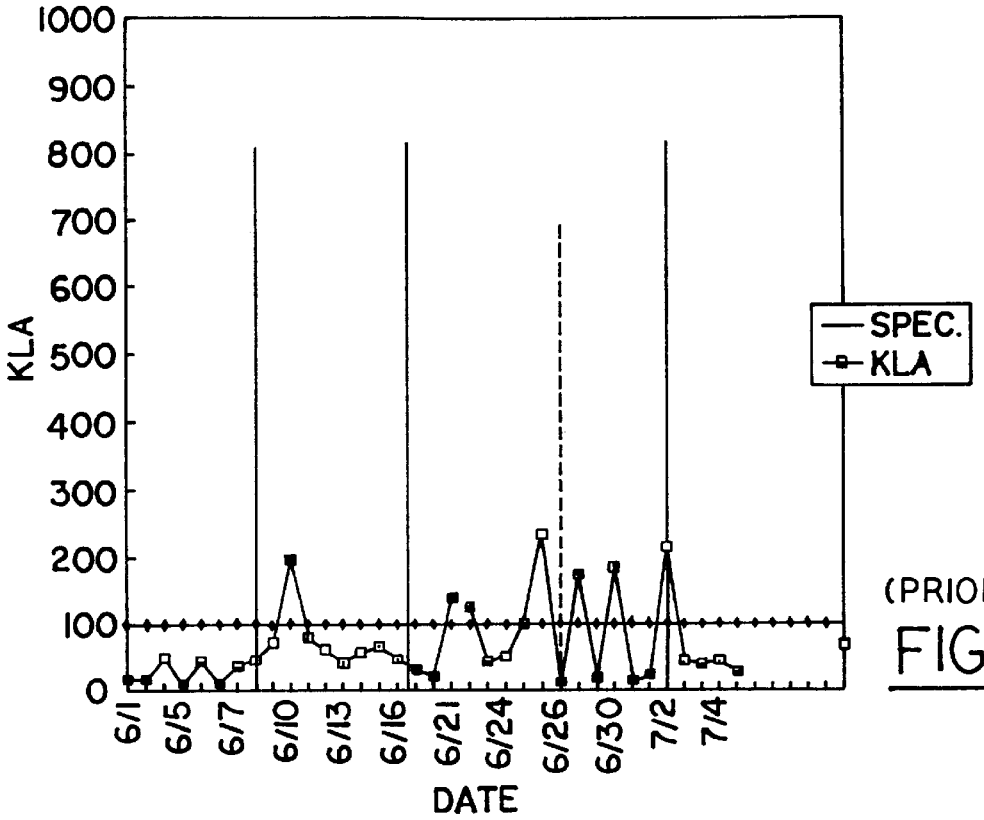
(PRIOR ART) FIG. 3
FIG. 3 is a graph illustrating data on particle contamination in a convention CMP apparatus.
Figure 4:
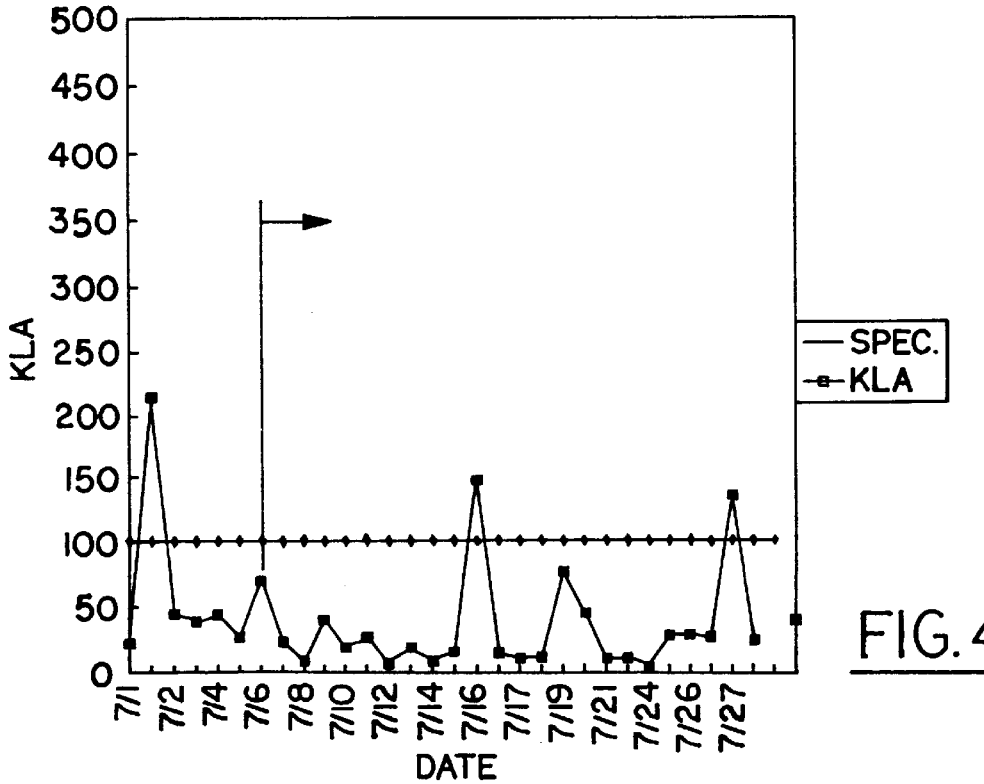
FIG. 4 is a graph illustrating a reduction in particle contamination in a CMP apparatus equipped with the present invention cleaning device.

The effectiveness of the present invention novel cleaning apparatus for a CMP machine can be demonstrated in FIGS. 3 and 4. FIG. 3 is a graph of a plot of particle counts vs. Time during a time period of approximately 33 days illustrating the occurrence of seven events of particle contamination which were higher than the maximum allowable particle count of 100, prior to the implementation of the present invention novel cleaning method for the CMP chamber. After the implementation of the present invention novel cleaning method and apparatus, data collected is shown in FIG. 4 which shows that during a time period of approximately 22 days, only two events of particle contamination were observed when the particle count exceeded the maximum allowable count of 100. A 72% reduction in the contaminating particle events is therefore achieved when the present invention novel method and apparatus are implemented.

The present invention novel method and apparatus have therefore been amply demonstrated in the above descriptions and in the appended drawings of FIGS. 2A–2D and FIG. 4.

The present invention has been described in terms of a preferred embodiment, it is to be appreciated that those skilled in the art will readily apply these teachings to other possible variations of the invention.

The embodiment of the invention in which an exclusive property or privilege is claimed are defined as follows:

1. A method of preventing particle contamination in a polishing machine utilizing slurry comprising the steps of:

providing at least one polishing head mounted in at least one spindle for holding at least one substrate having a surface to be polished in a face-down position, providing at least one polishing disc for holding a polishing pad having a frictional surface in a face-up position, pressing said surface of the substrate against said frictional surface of the polishing pad while said at least one polishing head and said at least one polishing disc rotate in opposite directions, dispensing a particle-containing slurry inbetween said substrate surface and said frictional surface, and dispensing a cleaning solvent on said at least one spindle for preventing accumulation of said particle-containing slurry on vertical and horizontal surfaces of said at least one spindle.

2. A method for preventing particle contamination in a polishing machine utilizing slurry according to claim 1 further comprising the step of providing a chemical mechanical polishing machine equipped with at least one polishing head mounted in at least one spindle.

3. A method for preventing particle contamination in a polishing machine utilizing slurry according to claim 1 further comprising the step of providing three polishing heads mounted in three spindles, respectively.

4. A method for preventing particle contamination in a polishing machine utilizing slurry according to claim 1 further comprising the step of providing said at least one substrate in a silicon wafer.

5. A method for preventing particle contamination in a polishing machine utilizing slurry according to claim 1 further comprising the step of providing a head clean/load/unload station in said polishing machine adapted for head cleaning, wafer load and unload operations.

6. A method for preventing particle contamination in a polishing machine utilizing slurry according to claim 1 further comprising the step of dispensing a cleaning solvent of deionized (DI) water on said at least one spindle.

7. A method for preventing particle contamination in a polishing machine utilizing slurry according to claim 1 further comprising the step of providing a plurality of solvent dispensing conduits each equipped with a spray nozzle and a flow regulator for dispensing said cleaning solvent.

8. A method for preventing contamination in a chemical mechanical polishing apparatus according to claim 7, wherein said plurality of solvent dispensing conduits are formed of bendable, shapable tubes constructed of helical plastic tapes.

9. A method for preventing contamination in a chemical mechanical polishing apparatus according to claim 7 further comprising the step of regulating a pressure of solvent flowing through said solvent dispensing conduits with a pressure regulator.

10. A method for preventing particle contamination in a polishing machine utilizing slurry according to claim 1, wherein said plurality of solvent dispensing conduits are formed of bendable, shapable pipes capable of being bent and being held in its deformed shape.

11. A method for preventing particle contamination in a polishing machine utilizing slurry according to claim 1, wherein said plurality of solvent dispensing conduits are formed of bendable, shapable tubes constructed in helical metal tapes.

12. A method for preventing particle contamination in a polishing machine utilizing slurry according to claim 1 further comprising at least one solvent dispensing conduit situated at each one of the corners of said polishing machine.

13. A method for preventing contamination in a chemical mechanical polishing apparatus according to claim 1 further comprising the step of providing a plurality of solvent dispensing devices each equipped with an air atomizing nozzle and regulator for dispensing said cleaning solvent.

14. A polishing machine equipped with a cleaning apparatus for preventing particle contamination on a substrate comprising:

a machine base portion having at least one spindle equipped with a polishing head and at least one corresponding polishing disc with a polishing pad mounted therein, a spindle equipped with a polishing head and a corresponding head clean/load/unload disc mounted on said machine base portion, a plurality of cleaning devices each comprising a bendable, shapable conduit and a spray nozzle adapted for dispensing a cleaning solvent and are mounted on said machine base portion with at least one cleaning device juxtaposed to each of said at least one spindle equipped with a polishing head, and a cleaning solvent reservoir for supplying a pressurized flow of cleaning solvent through said plurality of cleaning devices for cleaning vertical and horizontal surfaces on said at least one spindle for preventing particle accumulation.

15. A polishing machine equipped with a cleaning apparatus for preventing particle contamination on a substrate according to claim 14, wherein said machine base portion being equipped with four spindles each having a polishing head, three polishing discs and a head clean/load/unload station.

16. A polishing machine equipped with a cleaning apparatus for preventing particle contamination on a substrate according to claim 14, wherein said four spindles are mounted on a unitary cross member equipped with four motors for rotating said four spindles.

17. A polishing machine equipped with a cleaning apparatus for preventing particle contamination on a substrate according to claim 14, wherein said bendable, shapable conduit being formed of helical metal tape.

18. A polishing machine equipped with a cleaning apparatus for preventing particle contamination on a substrate according to claim 14 further comprising:

a conditioner arm equipped with a conditioner disc for each of said polishing disc equipped with polishing pad, said conditioner arm being mounted on said machine base portion, and a cleaning device including a bendable, shapable conduit and a spray nozzle mounted on said machine base portion juxtaposed to each of said conditioner arm.

19. A polishing machine equipped with a cleaning apparatus for preventing particle contamination on a substrate according to claim 14 further comprising a cleaning solvent reservoir for supplying a pressurized flow of DI water through said plurality of cleaning devices.

20. A method for preventing contamination in a chemical mechanical polishing apparatus according to claim 14 further comprising a compressed gas for supplying a pressurized flow of gas through said plurality of cleaning devices to create an atomized cleaning solvent.

21. A method for preventing contamination in a chemical mechanical polishing apparatus according to claim 14 further comprising a pressure regulator for regulating the pressure of cleaning solvent flowing through said conduits.

22. A method for preventing particle contamination in a chemical mechanical polishing apparatus comprising the steps of:

providing at least one polishing head mounted in at least one spindle for holding a wafer, providing at least one conditioner arm equipped with a conditioner disc, mounting said at least one spindle and said at least one conditioner arm on a machine base portion of said polishing apparatus, mounting a cleaning device comprising a bendable, shapable conduit and a spray nozzle juxtaposed to each of said at least one spindle and said at least one conditioner arm, polishing a wafer held in said at least one polishing head against a corresponding polishing pad while both rotating in apposite directions with a slurry dispensed thereinbetween, and dispensing a cleaning solvent from said spray nozzle on said at least one spindle and said at least one conditioner arm and removing any slurry deposited thereon to prevent particle contamination on said wafer.

23. A method for preventing contamination in a chemical mechanical polishing apparatus according to claim 22 further comprising the step of providing four polishing heads mounted in four spindles for holding wafers.

24. A method for preventing contamination in a chemical mechanical polishing apparatus according to claim 22, wherein said cleaning solvent dispensed is DI water.

25. A method for preventing contamination in a chemical mechanical polishing apparatus according to claim 22 further comprising the step of providing a cleaning solvent reservoir for dispensing a pressurized cleaning solvent of DI water.

* * * * *